US005380971A

United States Patent [19]

Bittel et al.

[11] Patent Number: 5,380,971

[45] Date of Patent: Jan. 10, 1995

[54] DYNAMIC BRAKE SWITCH FOR MOTOR

[75] Inventors: Robert W. Bittel, Parma Hts.; Michael J. Riedel, Northfield, both of Ohio

[73] Assignee: Lucerne Products, Inc., Hudson, Ohio

[21] Appl. No.: 973,183

[22] Filed: Nov. 9, 1992

[51] Int. Cl.[6] ..... H01H 1/36

[52] U.S. Cl. ..... 200/536; 200/547; 200/549; 200/522

[58] Field of Search ..... 200/536, 537, 547, 549, 200/550, 522, 252, 260, 16 R, 16 A, 16 C, 1 B, 1 V, 33 R, 549, 550, 275

[56] References Cited

U.S. PATENT DOCUMENTS

| | | | |
|---|---|---|---|
| 3,209,088 | 9/1965 | Wanlass et al. | 200/550 |
| 3,564,181 | 2/1971 | Chirota | 200/1 V |
| 4,168,405 | 9/1979 | Raab et al. | 200/16 C |
| 4,210,791 | 7/1980 | Sovenson | 200/550 |

*Primary Examiner*—Henry J. Recla
*Assistant Examiner*—David J. Walczak
*Attorney, Agent, or Firm*—Renner, Kenner, Greive, Bobak, Taylor & Weber

[57] ABSTRACT

A power switch is provided for control of the electric motor of a power hand tool, such switch including a shorting bar to achieve a dynamic brake on the motor after the termination of the application of power thereto. In one embodiment of the invention, the shorting bar is fixed within the switch housing and moving contacts upon the slide are brought into contact therewith after the slide has moved a sufficient distance to terminate the interconnection between the power source and the motor. In another embodiment, the shorting bar is maintained upon the slide and engages fixed contacts interconnected with the motor when the slide has moved a fixed distance beyond a point of disconnecting the power source from the motor.

6 Claims, 2 Drawing Sheets

DYNAMIC BRAKE SWITCH FOR MOTOR

TECHNICAL FIELD

The invention herein resides in the art of dynamoelectric machines and, more particularly, to electric motors. Specifically, the invention relates to a switch for motor control which includes means for providing a dynamic brake to the motor. Most particularly, the invention relates to a switch providing a dynamic brake for a motor of the type used in hand tools and the like.

BACKGROUND ART

It is well known that electric power tools are used extensively in manufacturing and service industries. Additionally, hand tools of such nature are routinely used by the home craftsman and handyman. Typically, such power tools are switch actuated and controlled. Hand tools generally employ a trigger switch to control the on/off function which may also include variable speed control. Presently, such trigger switches are generally spring biased to the "off" position such that release of the trigger switch results in a termination of operation of the hand tool. Such biased switches are often referred to as "deadman" switches since termination of control by an operator over the switch deactuates the switch.

Even when a deadman switch is employed, it is known that when the trigger of the switch is released the inertia and back EMF of the motor causes the same to continue to rotate or run until the inertia and/or back EMF is dissipated. Such characteristics of motors often defeat the purpose and intent of the deadman feature of the switch. In the prior art, there is generally not provided a brake on the motor such that the termination of electrical power to the motor assures immediate termination of motor rotation.

There is a need in the art for an immediate and reliable shorting of the motor coils to instantaneously dissipate the back EMF of the motor upon termination of power thereto, thereby locking the motor rotor. Indeed, there is a need in the art for a dynamic brake for a motor, which dynamic brake may be efficiently and effectively maintained in the trigger switch housing.

DISCLOSURE OF INVENTION

In light of the foregoing, it is a first aspect of the invention to provide, a dynamic brake for an electric motor for use in a hand tool.

A further aspect of the invention is to provide a switch in interconnection with an electric motor to short the back EMF of the motor after power to the motor is terminated.

Another aspect of the invention is to provide a switch in interconnection with an electric motor to short the back EMF of the motor in proper timed sequence with respect to termination of power application to the motor to assure safe and efficient battery usage.

Still a further aspect of the invention is the provision of a dynamic brake for an electric motor in which the components of the dynamic brake are maintained within the control switch, thereby being protected from the environment.

Yet an additional aspect of the invention is to provide a dynamic brake which may be combined with a presently existing switch by the addition of a shorting bar operative to engage laterally opposed motor contacts.

Still a further aspect of the invention are attained by a dynamic brake for motor control which is reliable and durable in operation, while being easily and inexpensively combined with existing motors and switch controls.

The foregoing and other aspects of the invention which will become apparent as the detailed description proceeds are achieved by a dynamic brake for a motor, comprising: a switch housing; a first pair of stationary contacts within said switch housing and adapted for interconnection with the motor; a second pair of stationary contacts within said switch housing and adapted for interconnection with a power source; a slide member slidingly received upon said first and second pairs of said stationary contacts; and a shorting member positioned for interconnecting said contacts of said first pair of stationary contacts when said slide member is in a predetermined position.

Other aspects of the invention which will become apparent herein are attained by a motor switch providing a dynamic brake, comprising: a housing; a first pair of stationary contacts maintained within said housing; a second pair of stationary contacts made within said housing; a slide member slidingly received within said housing and in selective positional engagement with said first and second pairs of stationary contacts; biasing means within said housing urging said slide member to a first position; and shorting means within said housing for shorting said contacts of said first pair of contacts together when said slide member is in said first position.

DESCRIPTION OF DRAWINGS

For a complete understanding of the objects, techniques, and structures of the invention, reference should be made to the following detailed description and accompanying drawings wherein.

BEST MODE FOR CARRYING OUT THE INVENTION

Figure 1:
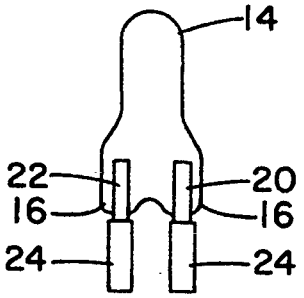
FIG. 1 is an illustrative front elevational view of a first embodiment of the dynamic brake of the invention.
Figure 2:
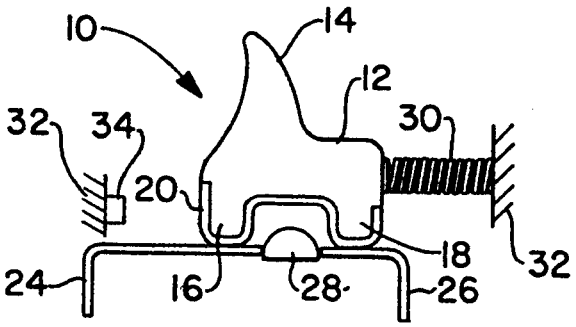
FIG. 2 is an illustrative side elevational view of the embodiment of FIG. 1.

Referring now to the drawings and more particularly FIGS. 1 and 2, it can be seen that an electrical switch assembly for implementation with a power hand tool is illustratively designated by the numeral 10. The switch assembly 10 includes a slide mechanism 12 having a trigger 14 at a front end thereof for engagement with an operator's finger for actuation of the switch. Those skilled in the art will readily appreciate that such actuation serves to interconnect a power source with an associated motor for energization of the motor.

In the illustrative embodiment shown, the slide mechanism 12 includes a pair of front legs 16 in spaced apart relationship with a corresponding pair of aligned rear legs 18. A conductive strip 20 extends from one of the front legs 16 to the aligned rear leg 18, while a second corresponding conductor strip 22 extends from the other front leg 16 to its aligned rear leg 18. Accordingly, conductive strips 20, 22 are substantially parallel to each other and spaced apart on either side of the slide mechanism 12. While the conductive strips 20, 22 are shown as being directly secured to the slide mechanism 12, it will be appreciated that such conductive strips may be replaced with spring biased conductive lugs as are known in the art.

The switch assembly 10 further includes a pair of parallel and spaced apart contacts 24 and a similarly parallel and spaced apart pair of contacts 26. The spacing between the contacts of the pairs 24 and 26 is such as to contactingly and slidingly receive the conductive strips 20, 22 of the slide mechanism 12. Those skilled in the art will appreciate that one of the pairs of contacts 24, 26 is adapted for interconnection with the motor of the associated power hand tool, while the other pair is adapted for interconnection with a battery or other suitable power source. In the embodiment of the invention as shown, the forward contacts 24 are adapted to interconnect with the motor, while the rearward contacts 26 are provided for interconnection with a power source.

A cam or pair of cams 28 is provided in interposition between the pairs of contacts 24, 26. A spring 30 is interposed between an enclosed housing 32 and the slide mechanism 12. The enclosed housing 32 is adapted to receive the slide mechanism 12, contacts 24, 26, and a shorting bar 34 to be discussed directly below. The spring 30 biases or urges the slide mechanism 12 to the left as shown in FIG. 2, such that the legs 18 ride upon and over the cam or cams 28 to disengage the conductive strips 20, 22 from the associated battery contact strips or ways 26. The shorting bar 34 is adapted for engagement with front portions of the conductive strips 20, 22 at the front legs 16 in a manner and for purposes presented directly below.

As shown in FIG. 2, an operator's finger (not shown) engages the trigger 14 to urge the slide mechanism 12 against the biasing of the spring 30 to a point where the conductive strips 20, 22 interconnect respective ones of the motor contacts 24 and battery or power contacts 26. Such comprises the operative mode of the power tool, with power passing, for example, from the power source through the conductive strip 20 to the motor and from the motor through the conductive strip 22, and returned to the battery.

Figure 3:
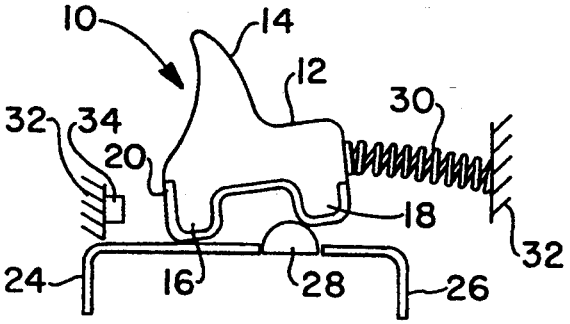
FIG. 3 is an illustrative side elevational view of the embodiment of FIG. 1 showing the same in a position in which power is disengaged from the motor.
Figure 4:
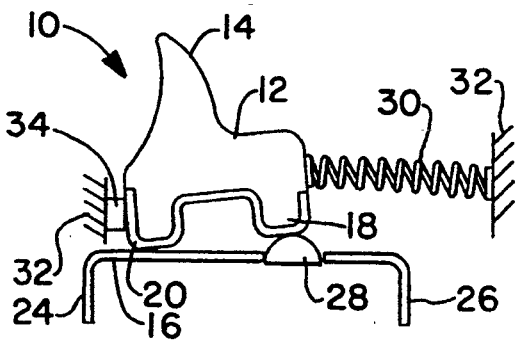
FIG. 4 is an illustrative side elevational view of the embodiment of FIG. 1, showing the switch in a position shorting the motor coils.

With reference to FIG. 3, the positioning of the slide mechanism 12 within the enclosed housing 32 may be appreciated when the associated motor is being turned off by disconnection of the power source therefrom. Upon release of pressure by the operator's finger, either total or partial, the spring 30 urges the slide mechanism 12 to the left as shown in FIG. 3 such that the rear legs 18 engage the cam surfaces 28 and lift from engagement with the associated battery contacts 26. Such activity disconnects the battery power source from the motor to terminate the operation thereof. As pressure is further released from the trigger 14, the spring 30 continues to urge the slide mechanism 12 to the left as shown in FIGS. 3 and 4 until such a point that the front end of the conductive strips, 20, 22 engage a shorting bar 34 which is attached to or otherwise fixed with respect to the enclosed housing 32. The conductive shorting bar 34 interconnects the conductive strips 20, 22 and accordingly interconnects with the pair of motor contacts 24, shorting the motor windings to each other. Such action serves to immediately dissipate any back EMF within the motor, providing instant termination of the rotation thereof.

Figure 5:
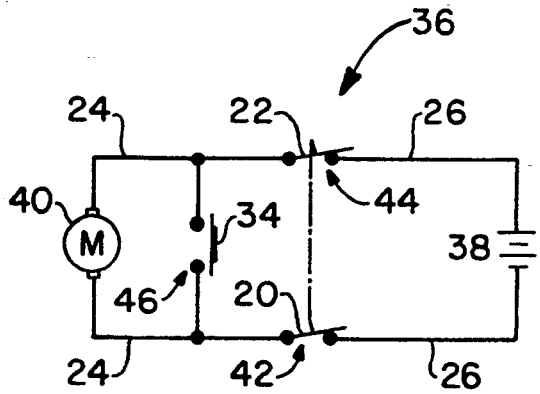
FIG. 5 is a circuit schematic illustrating the switch position of FIG. 2.
Figure 6:
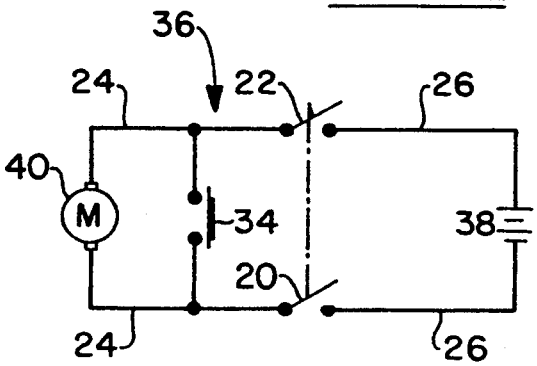
FIG. 6 is a circuit schematic showing the switch position of FIG. 3.
Figure 7:
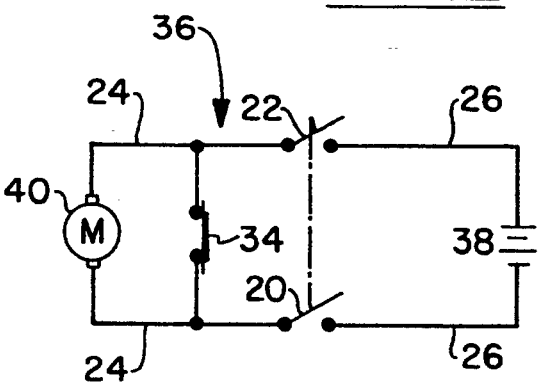
FIG. 7 is a circuit schematic showing the switch position of FIG. 4.

FIGS. 5, 6 and 7 respectively demonstrate the equivalent circuit 36 of the switch assembly 10 in its various stages of actuation as respectively illustrated in FIGS. 2, 3 and 4. As shown in FIG. 5, when the switch is in the normal operating position of FIG. 2, a battery 36 is interconnected with the motor 40 through the conductive strips 20, 22, shown as interconnecting respective motor and battery contacts 24, 26. In this stage of operation, the shorting bar 34 is out of contact with the conductive strips 20, 22 and, accordingly, is out of contact with the pair of motor contacts 24. It will be appreciated that the activities of the conductive strips 20, 22 are respectively illustrated as switches 42, 44 in the illustrations of FIGS. 5–7, while the shorting bar 34 is designated as a switch 46.

With reference now to FIG. 6, it can be seen that when the slide mechanism 12 is in the position illustrated in FIG. 3, the strips 20, 22 are disengaged from the battery contacts 26, disconnecting the battery 38 from the motor 40. At this point, the shorting bar 34 remains disengaged from the conductive strips 20, 22 and, accordingly, from the motor contacts 24.

As shown in FIGS. 4 and 7, when the spring 30 has urged the slide mechanism 12 to a terminal point such that the shorting bar 34 interconnects the conductive strips 20, 22, the windings of the motor 40 are shorted together through the motor contacts 24. At this point in time, the battery 38 is still disconnected from the motor 40 to obviate the possibility of a short circuit across the power source.

When operation of the motor 40 is desired anew, the reverse operation of that described is undertaken. The operator moves the trigger 14 such that the slide mechanism 12 disengages the shorting bar 34 from the conductive strips 20, 22, as shown in FIG. 3 and as illustrated in the schematic of FIG. 6. Continued movement of the operator's finger upon the trigger 14 causes the rear legs 18 to pass over the cam surfaces 28 such that the conductive strips 20, 22 respectively interconnect associated motor and battery contacts 24, 26, such as shown in FIGS. 2 and 5, the normal mode of motor operation. Accordingly, effective engagement of the shorting bar 34 with the motor contacts 24 is last achieved at motor turnoff, and the disengagement of the shorting bar 34 from the motor contacts 24 is first achieved at motor turn-on. Accordingly, there is no risk of shorting the battery, 38.

The embodiment of FIGS. 1–7 illustrates a stationary shorting bar which is contacted by the moving contacts of the slide mechanism 12. It is also contemplated that the shorting bar may be maintained upon the slide mechanism itself and brought into engagement with the motor contact upon termination of motor operation. Such an embodiment is illustrated in the partial sectional assembly diagram of FIG. 8. As shown therein, a switch assembly 50 includes a housing 52 adapted to receive a trigger assembly 54. The trigger assembly 54 includes a trigger 56 positioned at an end of a slide 58 which is slidingly received within a passage 60 within the housing 52. A switch block 62, as well known and understood by those skilled in the art, is received within a bottom portion of the housing 52 and is provided with a raised guide or way adapted to receive the slide 58 by engagement with a groove maintained within the bottom of the slide 58. Again, such structure is well known and understood by those skilled in the art. As in the embodiment of FIGS. 1–7, pairs of stationary contacts 66 are maintained in parallel spaced apart relationship with a corresponding pair of stationary contacts 68, the pairs being separated by the guide 64, and the contacts of each pair being separated by means of respective cams 70, 72 interposed therebetween.

Sliding contacts 74, 76 are received within the bottom of the slide 58 and are appropriately biased by associated springs 78, 80 into respective engagement with the contacts of the contact pairs 66, 68. Again, and as will be readily understood by those skilled in the art, the cam surfaces 70, 72 are positioned for operative deflecting engagement with the contacts 74, 76 to turn the motor on or off and, if desired, to achieve desired speed regulation or motor control.

It will be readily appreciated by those skilled in the art that a pair of the contacts 66, 68 will be adapted for interconnection with the motor windings, while the other pair of the contacts 66, 68 will be adapted for interconnection with a power source or battery. The specific arrangement of interconnection will be dependent upon the inclusion of reversing mechanisms, locking devices, and the like.

A spring 82 is interposed between a rear wall or stop of the housing 52 and the slide 58 and is operative within the passage 60 to bias or urge the slide 58 from the passage 60. As will also be appreciated by those skilled in the art, an opening 84 is provided within the housing 52 for receipt of an arm adapted for engagement with a reversing mechanism (not shown) which might be employed with the switch 50. The arm received within the opening 84 may also be adapted for engagement with the rib upon the top portion of the slide 58 to serve as a locking mechanism or the like to preclude actuating movement of the trigger 56.

A pair of contacts 88 (only one shown) are received in receptacles 90 provided on opposite sides of the housing 52, the contacts 88 being provided for fixed interconnection with the motor being controlled by the switch assembly 50.

Also included as a novel feature of the instant invention is the provision of a pair of pins 92 extending downwardly through a top surface of the housing 52 and into the passage 60. The pins 92 are engaged by respective ones of the motor contacts 88, by engagement of a tab 94 extending from the contact 88 and engaging the head of the associated pin 92. Accordingly, the potential of the associated motor contact is present on the pins 92.

Also provided as part and parcel of the invention is a contact 96 received and maintained within a recess or depression 98 on the top surface of the slide 58 and retained therein by an appropriate pin or screw 100. The contact 96 is so positioned with respect to the pins 92 as to engage the pins 92 in a physical stopping or abutting action when the slide 50 is urged by the spring 82 to a point where the contact 96 and pins 92 are aligned.

It will further be appreciated that the housing 52 is enclosed and provides a dust and debris free environment for the stationary contacts 66, 68, sliding contacts 74, 76, pins 92, and contact 96. Accordingly, reliable operation is attained.

In use, movement of the slide 58 by means of the application force upon the trigger 6 causes the contacts 74, 76 to ride upon the fixed contacts t6, 68, turning the motor on and off as a function of the position of the contacts 74, 76 with respect to the cam surfaces 70, 72 in much the same manner as discussed above with respect to FIGS. 1–7. When the force upon the trigger 56 is removed, or is insufficient to overcome the force of the spring 82, the slide 58 is urged in the passage 60 in such a direction that the sliding contacts 74, 76 ride up over the cam surfaces 70, 72 and break the contact of the battery with the motor. The moving contacts 74, 76 are lifted from the stationary contacts 66, 68 which are connected to the battery. As the slide 58 continues its movement in the same direction, the contact 96 ultimately comes into engagement with the pins 92, providing a short across the motor coils and dissipating any back EMF generated therein. As a consequence, the rotation of the associated motor immediately terminates.

Figure 8:
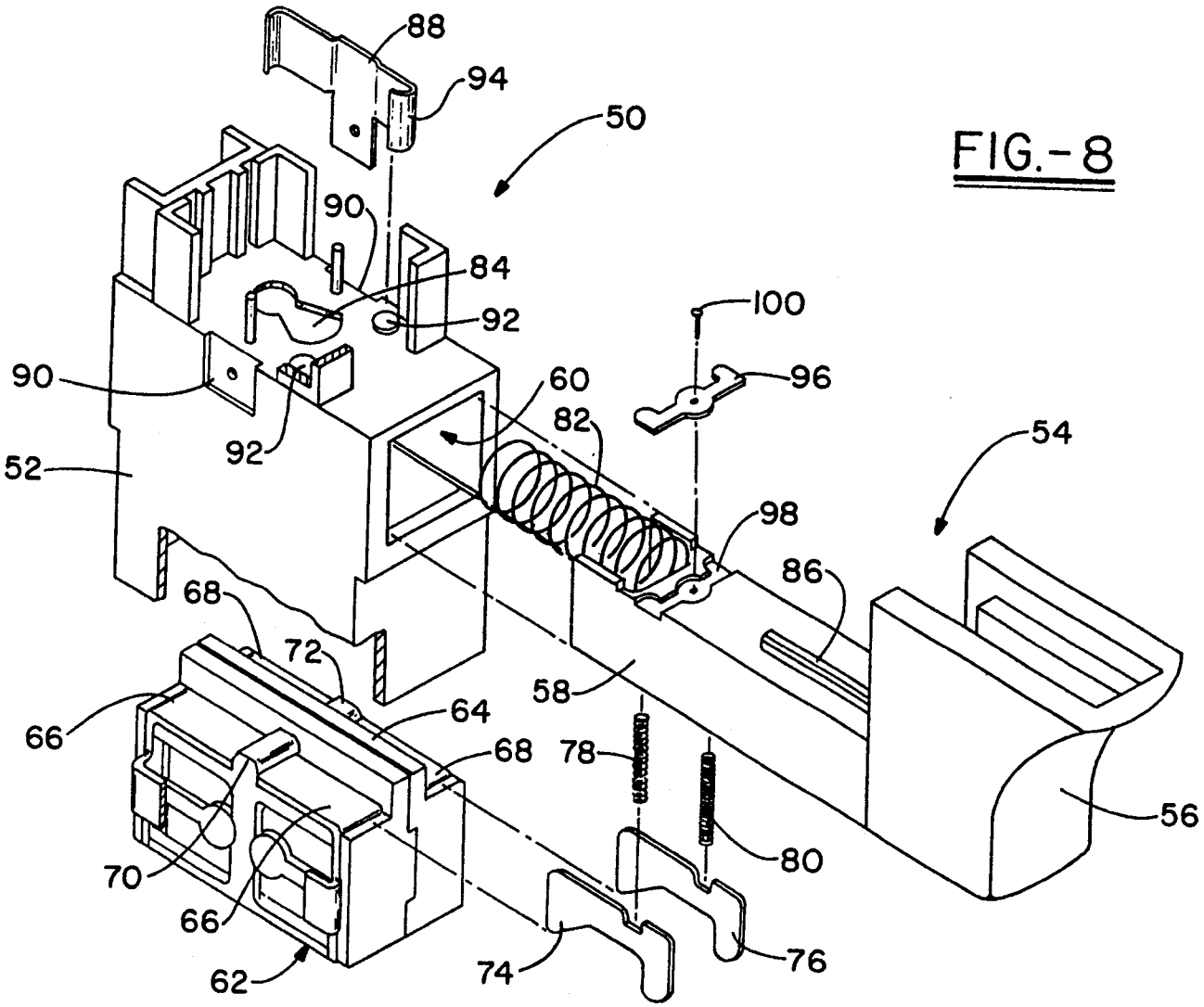
FIG. 8 is an assembly diagram, in partial sectional view, of a switch assembly according to a second embodiment of the invention.

It should now be understood by those skilled in the art that the embodiment illustrated in FIG. 8 provides for a moving shorting member or contact 96 which is brought into engagement with stationary contacts to achieve the desired shorting of the motor winding following termination of the application of power thereto. This is in contradistinction to the embodiment of FIGS. 1–7, in which the shorting bar is stationary and the contacts brought into engagement therewith. Of course, the concept of the invention remains the same, the shorting of the motor windings following the opening of the power source.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A dynamic brake for a motor, comprising:

a switch housing;

a first pair of stationary contacts within said switch housing and adapted for interconnection with the motor;

a second pair of stationary contacts within said switch housing and adapted for interconnection with a power source;

a slide member slidingly received within a passage upon said first and second pairs of said stationary contacts;

a shorting member received upon said slide member and positioned for interconnecting said contacts of said first pair of stationary contacts when said slide member is in a predetermined position; and a pair of conductors operatively interconnected with said first pair of stationary contacts and extending into said passage, said shorting member engaging said conductors when said slide member is in said predetermined position.

2. The dynamic brake according to claim 1, further comprising a third pair of stationary contacts adapted for interconnection with the motor and said first pair of stationary contacts, said third pair of stationary contacts engaging said pair of conductors.

3. The dynamic brake according to claim 2, wherein each said conductor comprises a pin contacted at a first end by one of said third pairs of stationary contacts and at a second end by said shorting member when said slide member is in said predetermined position.

4. The dynamic brake according to claim 2, wherein said shorting member comprises a conductive bar received by and traversing said slide member.

5. The dynamic brake according to claim 2, wherein said first and second pairs of stationary contacts, said shorting member, and said pair of conductors are retained and enclosed within said switch housing.

6. A motor switch for a dynamic brake, comprising:

a housing;

a first pair of stationary contacts maintained within said housing and adapted for interconnection with the motor;

a second pair of stationary contacts maintained within said housing and adapted for interconnection with a power source;

a slide member slidingly received within a path of travel within said housing and in selective positional engagement with said first and second pairs of stationary contacts;

biasing means within said housing urging said slide member to a first position; and shorting means within said housing for shorting said contacts of said first pair of contacts together when said slide member is in said first position, said shorting means comprising a conductor maintained upon said slide member; and a pair of pins extending from said first pair of contacts into said path of travel, said conductor engaging said pin and said slide member being disengaged from said second pair of stationary contacts when said slide member is in said first position.

* * * * *